US006623897B2

(12) United States Patent
Tomita

(10) Patent No.: US 6,623,897 B2
(45) **Date of Patent: *Sep. 23, 2003**

(54) IMAGE FORMING METHOD

(75) Inventor: Kunihiko Tomita, Hadano (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/734,842

(22) Filed: Dec. 13, 2000

(65) Prior Publication Data

US 2001/0006583 A1 Jul. 5, 2001

(30) Foreign Application Priority Data

Dec. 13, 1999 (JP) ..... 11-353336

(51) Int. Cl.[7] ..... G03G 13/20
(52) U.S. Cl. ..... 430/45; 430/124; 399/328
(58) Field of Search ..... 430/124, 45; 399/328

(56) References Cited

U.S. PATENT DOCUMENTS 3,948,215 A * 4/1976 Namiki ..... 399/328
4,992,833 A * 2/1991 Derimiggio ..... 399/328
5,220,383 A 6/1993 Enoki et al.
5,245,391 A 9/1993 Suzuki et al.
5,311,263 A 5/1994 Suzuki et al.
5,339,141 A 8/1994 Suzuki et al.
5,424,814 A 6/1995 Suzuki et al.
5,450,172 A 9/1995 Suzuki et al.
5,502,552 A 3/1996 Iwata et al.
5,527,657 A 6/1996 Takeda et al.
5,541,029 A 7/1996 Iwata et al.
5,557,392 A 9/1996 Iwata
5,783,348 A * 7/1998 Tyagi et al. ..... 430/124
5,809,386 A 9/1998 Iwata
5,812,917 A 9/1998 Iwata et al.
5,869,213 A 2/1999 Iwata et al.
6,370,350 B2 4/2002 Tomita
6,455,217 B2 9/2002 Tomita
6,492,084 B2 12/2002 Tomita

FOREIGN PATENT DOCUMENTS

EP 0848304 A * 6/1998

* cited by examiner

*Primary Examiner*—Christopher Rodee
(74) *Attorney, Agent, or Firm*—Oblon, Spivak, McClelland, Maier & Neustadt, P.C.

(57) ABSTRACT

An image forming method where a color image is formed on a support, and where the color image consists of a plurality of color toners each having a melting point or a softening point. The color image is heated upon application of pressure at a first temperature while the color image contacts a surface of a fixing member, where the first temperature is not lower than the melting points or softening points of the plurality of color toners. The color image is cooled to a second temperature lower than the melting points or softening points while the color image contacts the surface of the fixing member; and then the color image is separated from the fixing member, where the surface of the fixing member has a ten-point mean roughness not greater than 20 $\mu$m.

10 Claims, 4 Drawing Sheets

IMAGE FORMING METHOD

BACKGROUND OF THE INVENTION

1. Field of the Invention

The present invention relates to an image forming method useful for electrophotographic image forming apparatuses such as copiers, printers and facsimile machines, and more particularly to an image fixing method of full color toner images.

2. Discussion of the Background

Various electrophotographic full color image forming methods using three color toners of yellow, magenta and cyan toners, or four color toners of yellow, magenta, cyan and black toners have been proposed and practically used.

When the surface of color toner images is smooth, the toner images have high gloss because the surface of the toner images reflects light like a mirror. On the contrary, when toner images have rough surface, the toner images look frosted because light randomly reflects at the surface of the toner images. Therefore, when full color toner images are fixed by application of heat, the color toner images are typically fixed at a relatively high temperature to decrease the melt viscosity of the color toners constituting the color images, i.e., to prepare toner images having high gloss.

However, the gloss of the full color images prepared by the above-mentioned method is not satisfactory because the thus prepared black color image has too high a gloss, since the black toner tends to absorb heat more than the other color toners. Therefore, the color images are hard to see, and have low visual qualities.

In addition, when color images are fixed with a fixing roller at a temperature at which the color toners constituting the color images have low melt viscosity, an offset problem in which the color toners adhere to the fixing roller tends to occur.

A release agent, such as oils, is typically applied to the fixing roller to avoid the offset problem. Therefore, a release agent applying device is needed, and other problems occur, such that the image forming apparatus becomes large in size and manufacturing costs of the image forming apparatus increase.

Further, when the fixing method in which the fixing temperature is increased is used, the power consumption of the image forming apparatus increases. Therefore a requirement of low power consumption (i.e., a requirement to save energy) cannot be satisfied.

Because of these reasons, a need exists for an image forming method by which color toner images having uniform high gloss are stably obtained without causing the offset problem and without increasing manufacturing cost of the image forming apparatus.

SUMMARY OF THE INVENTION

Accordingly, an object of the present invention is to provide an image forming method by which color toner images having uniform high gloss are stably obtained without causing the offset problem and without increasing manufacturing cost of the image forming apparatus.

Briefly this object and other objects of the present invention as hereinafter will become more readily apparent can be attained by an image forming method including the steps of forming a color image which is formed on a support and which comprise a plurality of color toners each having a melting point or a softening point; heating the color image on the support with a fixing member upon application of pressure while the color image contacts a surface of the fixing member such that the color image is heated at a temperature not lower than the melting points or softening points of the plurality of color toners to melt or soften the color toners; and then cooling the color image to a temperature lower than the melting points or softening points while the color image contacts the surface of the fixing member; and then separating the color image from the fixing member, wherein the surface of the fixing member has a ten-point mean roughness not greater than 20 $\mu$m.

In the heating step, the pressure P (9.8×100 N/m) applied to the color image preferably satisfies the following relationship:

$$((9/5)\times \log\eta - 4/5)/15 \geqq P \geqq ((1/100)\times \log\eta)/15$$

wherein $\eta$ represents the melt viscosity of each of the color toners in units of centipoise at the temperature in the heating step.

The melt viscosities of the plurality of color toners are preferably from 10 to $10^{13}$ centi-poise.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features end attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides an image forming method including the steps of forming a color image on an image support and which comprises a plurality of color toners each having a melting point or a softening point; heating the color image on the support with a fixing member upon application of pressure while the color image contacts a surface of the fixing member such that the color image is heated at a temperature not lower than the melting points or softening points of the plurality of color toners to melt or soften the color toners; and then cooling the color image to a temperature lower than the melting points or softening points while the color image contacts the surface of the fixing member; and then separating the color image from the fixing member, wherein the surface of the fixing member has a ten point mean roughness not greater than 20 $\mu$m.

In the heating step, the pressure P (9.8×100 N/m) applied to the color image preferably satisfies the following relationship:

$$((9/5)\times log\eta-4/5)/15 \geqq P \geqq ((1/100)\times log\eta)/15$$

wherein η represents the melt viscosity of each of the color toners in units of centi-poise at the temperature in the heating step.

The melt viscosities of the plurality of color toners are preferably from 10 to $10^3$ centi-poise.

By using the image forming method mentioned above, color images having uniform high gloss can be prepared.

The image forming method of the present invention will be explained in detail referring to drawings.

Figure 1:
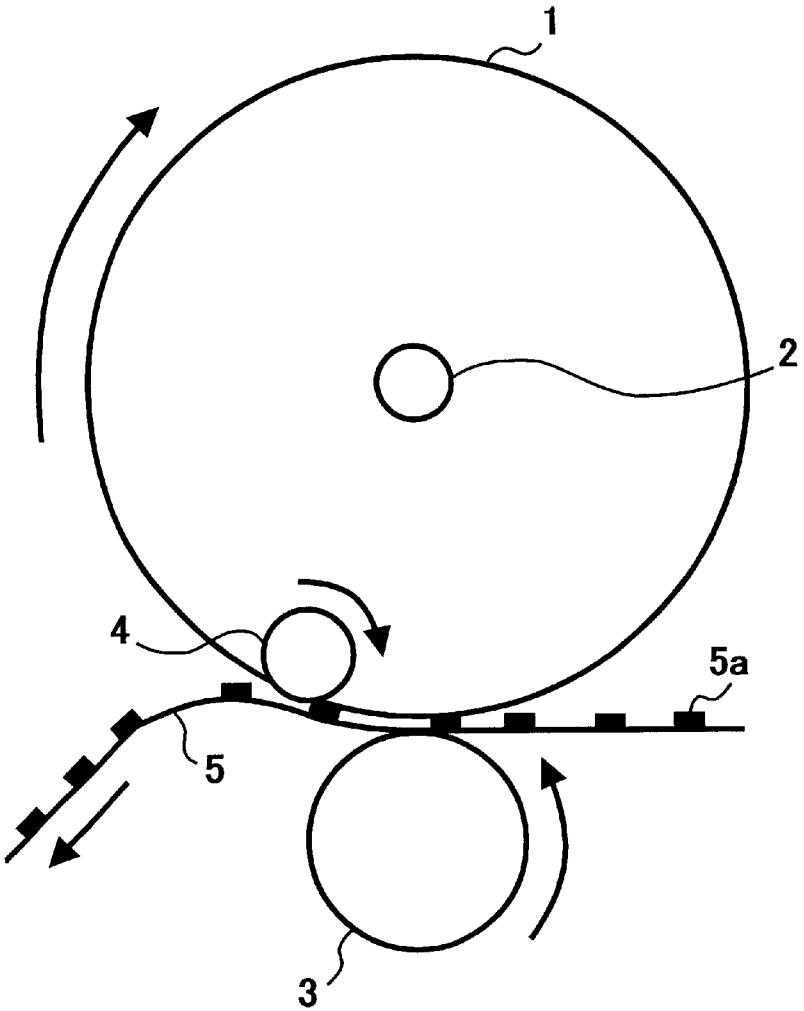
FIG. 1 is a schematic view illustrating a fixing device for use in the image forming method of the present invention.

FIG. 1 is a schematic view illustrating a fixing device for use in the image forming method of the present invention. In FIG. 1, numerals 1, 2, 3, 4, 5 and 5*a* respectively represent a fixing roller, a heating element, a pressure roller, a cooling member, an image support and color toner images. The fixing roller 1, pressure roller 3 and cooling member 4 rotate in the respective directions indicated by the respective arrows.

In this first embodiment, the image support 5 having the color toner images 5*a* thereon is fed to a nip between the fixing roller 1, which is heated by the heating element 2 and the pressure roller 3, to melt or soften the color toner images 5*a*. The image support 5 having the toner images 5*a* is further fed while the toner images are contacting the fixing rollers. Then the color toner images 5*a* are cooled at a point of the surface of the fixing roller 1 at which the cooling member 4 contacts the inside of the fixing roller 1 to cool the fixing roller 1. After the color toner images are cooled such that the temperatures of the color toner images become lower than the melting or softening points of the color toners comprising the color images, the image support 5 having the color toner images 5*a* is separated from the fixing roller 1. At this point, the surface of the fixing roller 1, with which the color toner images 5*a* contact, has good smoothness, i.e., a ten-point mean roughness not greater than 20 $\mu$m. Therefore, the resultant fixed color toner images 5*a* on the image support 5, which is separated from the fixing roller 1, have uniform high gloss.

Figure 2:
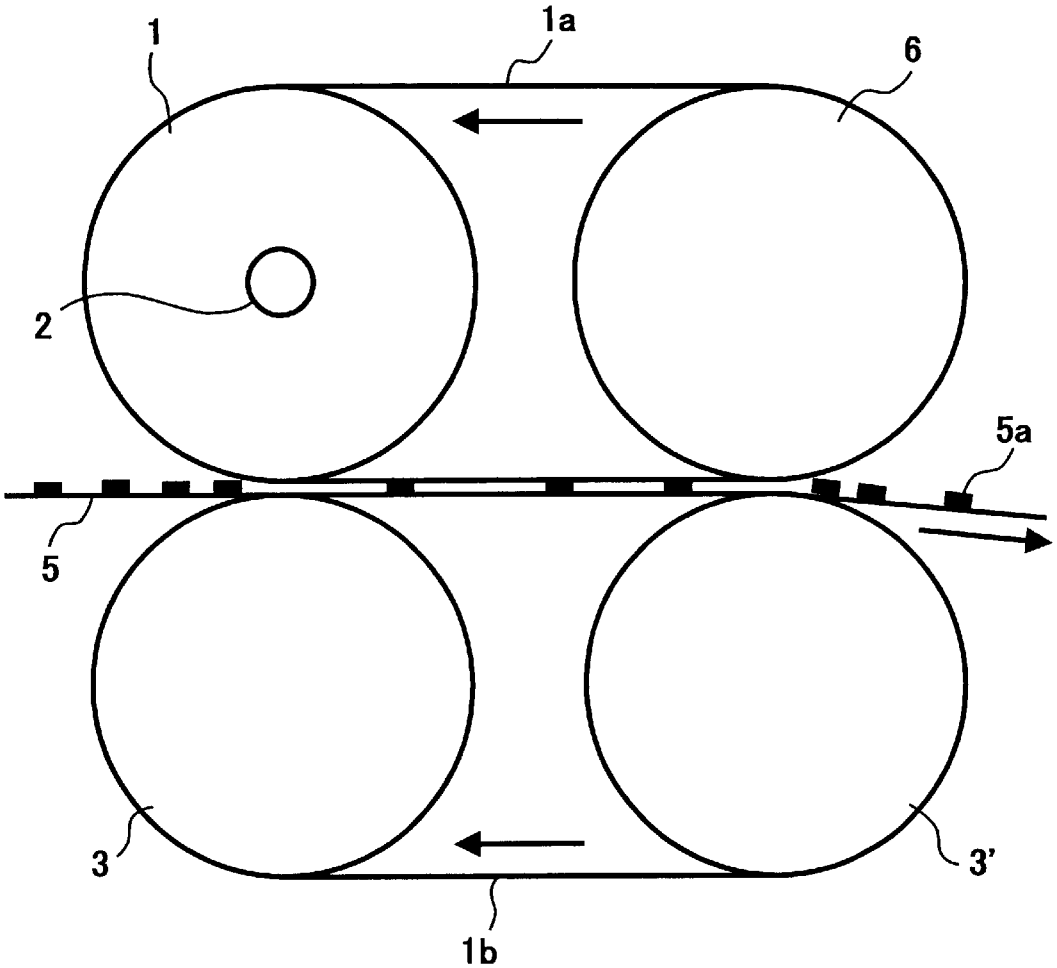
FIG. 2 is a schematic view illustrating another fixing device for use in the image forming method of the present invention.

The cooling member 4 may be rotated or fixed, and in addition the shape thereof is not particularly limited. In addition, a cooling medium such as water may be contained in, or may flow through, the cooling member 4 to actively cool the cooling member 4, and so to actively cool the fixing roller 1. FIG. 2 is a schematic view illustrating another fixing device for use in the image forming method of the present invention. In FIG. 2, numerals 1, 1*a* and 1*b* represent a fixing roller, a fixing belt and a supplementary belt, respectively. Numerals 2, 3, 3', 5, 5*a* and 6 represent a heating element, a pressure roller, another pressure roller, an image support, color toner images and a cooling roller, respectively. The cooling roller may include a forcible cooling means such as a flow of cooling liquid.

In this second embodiment, the endless fixing belt la, which is rotated in a direction indicated by an arrow by the fixing roller 1 and the cooling roller 6, serves as a fixing member, just as the fixing roller 1 serves as a fixing member in the first embodiment as shown in FIG. 1. In addition, the supplementary belt 1*b* is also rotated in a direction indicated by an arrow by the pressure rollers 3 and 3'. The image support 5 having the color toner images 5*a* thereon is heated to a temperature not lower than the melting points or softening points of the color toners constituting the color images at the nip between the fixing roller 1 and the pressure roller 3, namely between the fixing belt 1*a* and the supplementary belt 1*b*.

The color toner images 5*a* contact the surface of the fixing belt 1*a* at the nip between the fixing roller 1 end the pressure roller 3.

The image support 5 is then fed while the color toner images 5*a* keep contact with the fixing belt la and the supplementary belt lb. Then the color toner images 5*a* on the image support 5 are thereby cooled to a temperature lower than the melting points or softening points of the color toners at the nip between the cooling roller 6 and the pressure roller 3', namely between the fixing belt 1*a* and the supplementary belt 1*b*. Then the image support 5 having a fixed color image thereon is discharged from the fixing unit.

In the second embodiment, the pressure roller 3' and the supplementary belt 1*b* are not necessarily needed.

In addition, the color toner images 5*a* may be cooled by blowing cool air thereto at a position between the fixing roller 1 and the cooling roller 6. Further, the color toner images 5*a* may be naturally cooled by locating the cooling roller 6 far apart from the fixing roller 1.

In these cases, the cooling roller 6 may be replaced with an uncooled roller (i.e., the cooling roller 6 does not positively cool the color toner images 5*a*).

When the toner images 5*a* are cooled to a temperature lower than the melting points or softening points of the toners, the toner images 5*a* are separated from the fixing belt la. In the second embodiment, the surface of the fixing belt la to be contacted with the toner images 5*a* has good smoothness such that the ten-point mean roughness of the surface thereof is not greater than 20 $\mu$m. Therefore, the resultant fixed color image has uniform high gloss.

Figure 3:
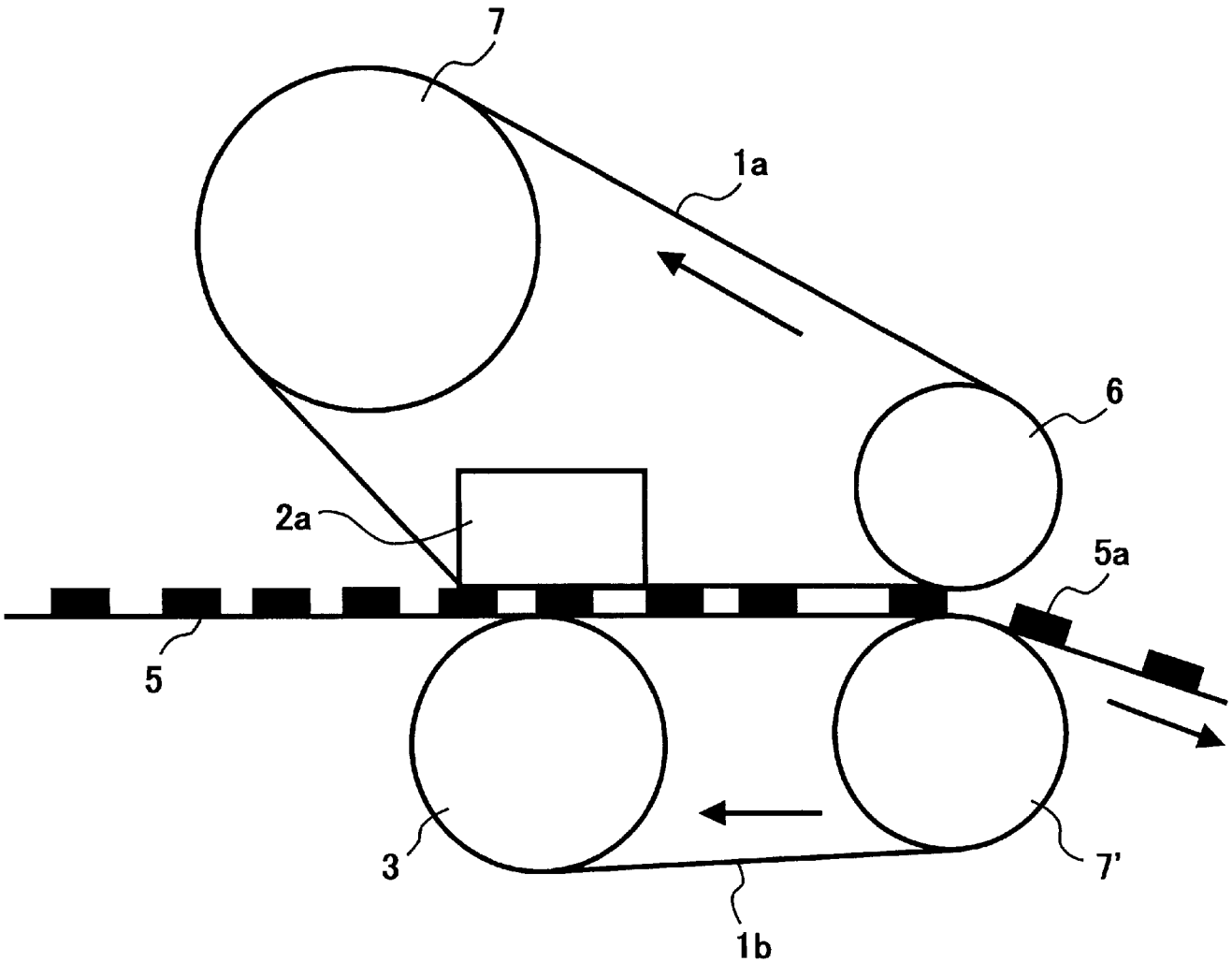
FIG. 3 is a schematic view illustrating yet another fixing device for use in the image forming method of the present invention.

FIG. 3 is a schematic view illustrating yet another fixing device for use in the image forming method of the present invention. In FIG. 3, numerals 1*a* and 1*b* represent a fixing belt and a supplementary belt, respectively. Numerals 2*a*, 3, 5, 5*a*, 6, 7 and 7' represent a linear heating element, a pressure roller, an image support, color toner images, a cooling roller, a supplementary roller and another supplementary roller, respectively.

In this third embodiment, the color toner images 5*a* on the image support 5 are heated by the linear heating element 2*a* with the fixing belt 1 therebetween while the image support 5 is pressed toward the linear heating element by the pressure roller 3. The image support 5 is fed by the fixing belt 1*a* and the supplemental belt 1*b*, which rotate in the respective directions indicated by the respective arrows. In FIG. 3, the supplementary roller 7' and the supplementary belt 1*b* are used, however, they are not necessarily needed. The fixing belt 1*a* is rotated by the supplementary roller 7 and the cooling roller 6. The supplementary roller 7 is not necessarily needed. In addition, as mentioned in the second embodiment, cooling of the color toner images 5*a* may be performed by the method of blowing cool air to the image support 5 or by naturally cooling by locating the cooling roller 6 far apart from the linear heating element 2*a*.

When the toner images 5*a* are cooled to a temperature lower than the melting points or softening points of the toners, the toner images 5*a* are separated from the fixing belt 1*a*. In the third embodiment, the surface of the fixing belt 1*a* to be contacted with the toner images 5*a* has good smoothness such that the ten-point mean roughness of the surface is not greater than 20 $\mu$m. Therefore, the resultant fixed color image has uniform high gloss.

In the image forming method of the present invention, the method of developing electrostatic latent images is not particularly limited. For example, image developing methods using a dry developer such as one component developer and two component developers or toner jet developing methods can be used. In addition, wet developing methods can also be used.

In conventional fixing methods, toners having relatively low melt viscosity of from $10^7$ to $10^{13}$ centi-poise are typically used to increase the gloss of the resultant fixed toner images. In addition, an oil is applied to a fixing member used for fixing toner images to avoid the offset problem. However, when a toner having a low melt viscosity less than $10^7$ centi-poise is used, the offset problem cannot be avoided only by the method in which an oil is applied to the fixing member used.

In the present invention, even when a toner having a low melt viscosity of from 10 to $10^7$ centi-poise is used, images of the toner can be stably fixed without applying an oil to the fixing member used.

In the present invention, the melt viscosity means a melt viscosity when a toner is heated to a fixing temperature higher than its melting point or softening point. The melting point and softening point of a toner can be determined as the softening temperature and flow starting temperature when thermal properties of the toner are measured using a flow tester manufactured by Shimazu Corp.

In general, when a thermoplastic resin (or a toner) is heated to a temperature, the resin keeps a solid state if the temperature is less than its softening point. When the resin is heated to a temperature higher that the softening point, the resin softens and becomes viscous. When the resin is further heated to a temperature higher then its melting point, the resin achieves a viscous liquid state. The temperature difference between the softening point and the melting point of a resin (or a toner), the viscosity of the resin at a temperature between the softening point and the melting point, and the viscosity of the resin at a temperature higher than the melting point depend on the molecular weight, molecular weight distribution, crystallinity, crosslinking degree, intermolecular force and the like properties of the resin.

When a toner having a viscosity of from 10 to $10^{13}$ centi-poise at a temperature between the softening point and the melting point is used, the fixing temperature is preferably set to be a temperature between the softening point and the melting point thereof. When a toner having a viscosity greater than $10^{13}$ centi-poise at a temperature between the softening point and the melting point and a viscosity of from 10 to 10¯centi-poise at a temperature higher than the melting point is used, the fixing temperature is preferably set to be higher than the melting point thereof.

By the method mentioned above, the offset problem can be avoided without applying an oil to the fixing member. However, the gloss of the resultant fixed color images is not fully satisfactory. The reason is considered to be as follows. When toner images are heated upon application of pressure at a fixing portion, the toner images are easily pressed and closely adhere to the surface of the fixing member because the viscosity of the melted toner images is relatively low. When such toner images are cooled and then separated from the fixing member, the surface of the toner images has almost the same roughness as the surface of the fixing member (i.e., the surface of the toner images is embossed by the surface of the fixing member). Therefore, if the surface of the fixing member is not smooth, the gloss of the resultant fixed toner images is not satisfactory.

As a result of the inventor's research, it is discovered that color images having uniform high gloss can be stably prepared under the following conditions:

(1) the surface of the fixing member used has a ten-point mean roughness not greater than 20 $\mu$m; and (2) the pressure applied to the image support having the toner images thereon by a pressure roller satisfies the following relationship:

$$((9/5)\times log\eta-4/5)/15 \geqq P \geqq ((1/100)\times log\eta)/15$$

wherein P represents the linear pressure in units of 9.8× 100 N/m; and η represents the melt viscosity of each of the color toners in units of centi-poise when the color toners are heated to a fixing temperature by the heating element.

As mentioned above, since the surface of toner images is embossed by the fixing member, it is the most preferable that the surface of the fixing member has a ten-point mean roughness of 0 $\mu$m. However, there is no fixing member having such a small roughness.

Therefore, it is preferable to control the roughness of the surface of the fixing member so as to be as small as possible, i.e., not greater than 20 $\mu$m.

When a toner having a relatively low melt viscosity of from 10 to $10^7$ centi-poise is used, the effects are prominently exerted by controlling the surface roughness and the linear pressure of the fixing member used within the above-mentioned ranges. Even when a toner having a relatively high melt viscosity of from $10^7$ to $10^{13}$ centi-poise is used, the effects can also be exerted.

As can be understood from the above-description, the smaller the roughness of surface of the fixing member, the better the gloss of the fixed color images. The ten-point mean roughness Rz of the fixing member used is not greater than 20 $\mu$m, preferably not greater than 5 $\mu$m, and more preferably not greater than 1 $\mu$m. Even more preferably the roughness Rz is not greater than 0.1 $\mu$m.

When the pressure applied to the color toner images is too low, the surface of the color image consisting of particles of color toners cannot be fully smoothed, resulting in deterioration of gloss of the resultant fixed color image. On the contrary, when the pressure is too high, the toner images tend to be spread, resulting in deterioration of resolution of the resultant color image.

Figure 4:
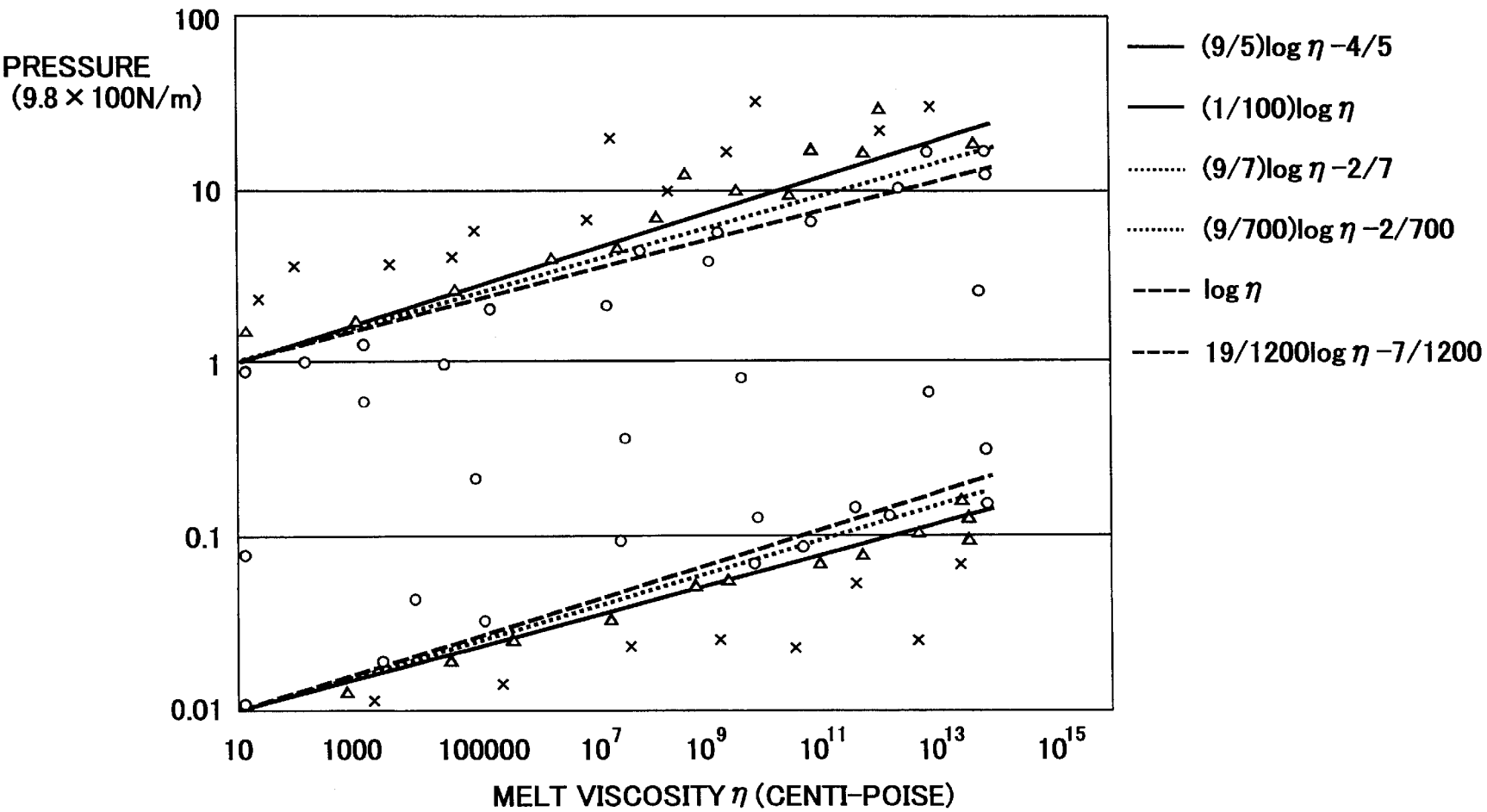
FIG. 4 is a graph illustrating the relationship among fixing pressure, melt viscosity of toner and image qualities of the fixed toner images.

As a result of the inventor's experiment in which a pressure is applied to both ends of a pressure roller while changing the level of the pressure when the viscosity of the toner is a parameter, the graph as shown in FIG. 4 is obtained. In FIG. 4, a circle mark (O) represents a fixing condition under which images having desired image qualities can be produced within the temperature/humidity conditions of from 5° C. and 10% RH to 35° C. and 80% RH.

A triangle mark ( ) represents a fixing condition under which images having desired image qualities can be produced under room temperature and normal humidity conditions. However, the resolution of the resultant image slightly deteriorates under high temperature and high humidity conditions and the adhesion between the toner image and the image support slightly deteriorates under low temperature and low humidity conditions.

A cross mark (X) represents a fixing condition under which the resolution of the resultant image seriously deteriorates under high temperature and high humidity conditions and the adhesion between the toner image and the image support seriously deteriorates under low temperature and low humidity conditions, resulting in peeling of the toner images from the image support.

As can be understood from FIG. 4, color images having good image qualities can be produced under the conditions between the two solid lines, preferably between the two dotted lines and more preferably between the two broken lines.

In FIG. 4, the pressure in the vertical axis is the pressure applied to one side of the pressure roller, and therefore the total pressure applied to the pressure roller is obtained by doubling the value. The length of the pressure roller used for the experiment is 30 cm.

As mentioned above, the linear pressure P of the pressure roller preferably satisfies the following relationship:

$$((9/5)\times log\eta-4/5)/15 \geqq P \geqq ((1/100)\times \log \eta)/15$$

More preferably, the linear pressure P satisfies the following relationship:

$$((9/7)\times log\eta-2/7)/15 \geqq P \geqq ((9/700)\times log\eta 2/700)/15$$

Even more preferably, the linear pressure P satisfies the following relationship:

$$(log\eta)/15 \geqq P \geqq ((19/1200)\times log\eta 7/1200)/15$$

At this point, the units of the pressure P and melt viscosity $\eta$ are 9.8×100 N/m and centi-poise, respectively.

The toner images fixed under the conditions mentioned above have uniform high gloss without deteriorating image qualities of the fixed images and the adhesion to the image support.

As the binder resin for use in the toner of the present invention, known resins is used for conventional toners can be used. Specific examples of the resins include homopolymers of styrene and substituted styrene, such as polystyrene, poly-p-chlorostyrene, polyvinyltoluene and the like; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methylchloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers and the like; and other resins such as polymethyl methacrylate, polybutyl methacrylate, polyvinyl chloride, polyvinyl acetate, polyethylene, polypropylene, polyesters, polyurethane resins, polyamide resins, epoxy resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like resins. These resins are used alone or in combination.

One or more of these resins are mixed with a colorant, such as carbon black or color pigments or dyes. If desired, additives such as charge controlling agents may be added to the mixture. Then the mixture is kneaded upon application of heat.

The kneaded mixture is then cooled and pulverized to prepare a mother toner. The mother toner may be mixed with a fluidity improving agent such as silica, titania and strontium oxide.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of color toner

Three kinds of yellow toners having a different melt viscosity were prepared. Similarly, three kinds of magenta toners, cyan toners and black toners were also prepared. The viscosity thereof at 110° C. and 140° C. are shown in Table 1.

TABLE 1

| | Viscosity at 110° C. (centi-poise) | Viscosity at 140° C. (centi-poise) |
|---|---|---|
| Yellow toner 1 | $10^7$ | $10^5$ |
| Yellow toner 2 | $10^9$ | $10^6$ |
| Yellow toner 3 | $10^{14}$ | $10^6$ |
| Magenta toner | $10^7$ | $10^5$ |
| Magenta toner 2 | $10^9$ | $10^6$ |
| Magenta toner 3 | $10^{14}$ | $10^6$ |
| Cyan toner 1 | $10^7$ | $10^5$ |
| Cyan toner 2 | $10^9$ | $10^6$ |
| Cyan toner 3 | $10^{14}$ | $10^6$ |
| Black toner 1 | $10^7$ | $10^5$ |
| Black toner 2 | $10^9$ | $10^6$ |
| Black toner 3 | $10^{14}$ | $10^6$ |

Example 1

Color toner images formed by each of the yellow toner 1, magenta toner 1, cyan toner 1 and black toner 1 were fixed using the fixing device of the second embodiment of the present invention. Each of the color toner images was fixed such that the temperature of the toner image was 140° C. The surface of the fixing members with which the color toner images contacted had a ten-point mean roughness Rz of 0.01 μm.

The procedure for preparation of the yellow color images was repeated with respect to the magenta toner 1, cyan toner 1 and black toner 1.

As a result, all the color images including the black toner images had high gloss as shown in Table 2.

The gloss of the color images was measured with a gloss meter manufactured by Nippon Denshoku Kogyo K. K. by a method based on JIS Z8741 The gloss was measured by irradiating the fixed color images with light whose angle of the incidence was 60°.

Example 2

The procedures of preparation of the color images and evaluation in Example 1 were repeated except that the color toners were changed to yellow toners, magenta toners, cyan toner 2 and black toner 2; the fixing temperature was changed to 110° C., and the ten-point mean roughness Rz of the surface of the fixing member was changed to 1 μm.

The results are also shown in Table 2. As a result, all the color images including the black toner images had high gloss.

Example 3

The procedures of preparation of the color images and evaluation in Example 1 were repeated except that the color toners were changed to yellow toners, magenta toners, cyan toner 3 and black toner 3, and the ten-point mean roughness Rz of the surface of the fixing member was changed to 5 μm.

The results are also shown in Table 2. As a result, all the color images including the black toner images had high gloss.

Comparative Example 1

The procedures of preparation of the color images and evaluation in Example 1 were repeated except that the fixing temperature was changed to 110°, and the ten-point mean roughness Rz of the surface of the fixing member was changed to 25 μm.

The results are also shown in Table 2. As a result, all the color images including the black toner images had relatively low gloss.

Example 4

The procedures of preparation of the color images and evaluation in Example 2 were repeated except that the black toner was changed to the black toner 3, and the ten-point mean roughness Rz of the surface of the fixing member was changed to 10 μm.

The results are also shown in Table 2. As a result, the yellow, magenta and cyan toner images had high gloss but the black toner image had a relatively low gloss.

Example 5

The procedures of preparation of the color images and evaluation in Example 2 were repeated except that the ten-point mean roughness Rz of the surface of the fixing member was charged to 20 μm.

The results are also shown in Table 2. As a result, all the color images including the black toner images had high gloss.

TABLE 2

| | Surface roughness of fixing member Rz (μm) | Gloss of color images (%) |
|---|---|---|
| Example 1 | 0.01 | 35 |
| Example 2 | 1 | 20 |
| Example 3 | 5 | 18 |
| Comparative Example 1 | 25 | 14 |
| Example 4 | 10 | 16 |
| Example 5 | 20 | 15 |

As can be understood from Tables 1 and 2, color images having relatively high gloss can be produced when the surface of the fixing member has a roughness not greater than 20 μm and the linear pressure P of the fixing device satisfies the following relationship:

$$((9/5)\times log-4/5)/15 \geqq P \geqq ((1/100)\times log\eta)/15$$

wherein the unit of the pressure is 9.8×100 N/m and η represents the melt viscosity of the toners consisting the color images in units of centi-poise.

This document claims priority and contains subject matter related to Japanese Patent Application No. 11-353336, filed on Dec. 13, 1999, incorporated herein by reference.

Having now fully described the invention, it will be apparent to one of ordinary skill in the art that many changes and modifications can be made thereto without departing from the spirit and scope of the invention as set forth therein.

What is claimed is:

1. An image forming method, comprising the steps of:

forming a color image on a support, said color image consisting of a plurality of color toners, each having a melting point or a softening point;

heating the color image upon application of a pressure at a first temperature while the color image contacts a surface of a fixing member, said first temperature being not lower than the melting points or softening points of the plurality of color toners, wherein said pressure applied satisfies the following relationship:

$$((9/5)\times log\eta 4/5)/15 \geqq P \geqq ((1/100)\times log\eta)/15,$$

wherein P represents said pressure in a unit of 9.8×100 N/m, and η represents melt viscosity of each of said color toners in a unit of centi-poise at said first temperature;

cooling the color image to a second temperature lower than the melting points or softening points while the color image contacts the surface of the fixing member; and separating the color image from the fixing member during the cooling step, wherein the surface of the fixing member has a ten-point mean roughness not greater than 20 μm.

2. The image forming method according to claim 1, wherein the surface of the fixing member has a ten-point mean roughness not greater than 10 μm.

3. The image forming method according to claim 1, wherein the surface of the fixing member has a ten-point mean roughness not greater than 5 μm.

4. The image forming method according to claim 1, wherein the surface of the fixing member has a ten-point mean roughness not greater than 1 μm.

5. The image forming method according to claim 1, wherein the surface of the fixing member has a ten-point mean roughness not greater than 0.1 μm.

6. The image forming method according to claim 1, wherein the pressure applied to the color image in the heating step satisfies the following relationship:

$$((9/7)\times \log\eta 2/7)/15 \geqq P \geqq ((9/700)\times \log\eta - 2/700)/15$$

wherein P represents the pressure in a unit of 9.8×100 N/m, and η represents the melt viscosity of each of the color toners in a unit of centi-poise at the first temperature in the heating step.

7. The image forming method according to claim 1, wherein the pressure applied to the color image in the heating step satisfies the following relationship:

$$(\log\eta)/15 \geqq P \geqq ((19/1200\times \log\eta - 7/1200)/15$$

wherein P represents the pressure in a unit of 9.8×100 N/m, and η represents the melt viscosity of each of the color toners in a unit of centi-poise at the first temperature in the heating step.

8. The image forming method according to claim 1, wherein the plurality of color toners have melt viscosities of from 10 to $10^{13}$ centi-poise at the first temperature.

9. The image forming method according to claim 1, wherein the plurality of color toners comprise a yellow toner, a magenta toner and a cyan toner.

10. The image forming method according to claim 1, wherein the plurality of color toners comprise a yellow toner, a magenta toner, a cyan toner and a black toner.

* * * * *